United States Patent [19]

Mattor

[11] 3,994,724

[45] Nov. 30, 1976

[54] PHOTOCONDUCTOR ELEMENTS CONTAINING SUBSTITUTED ANILINE PHOTOCONDUCTOR COMPOUNDS

[75] Inventor: John Alan Mattor, Bar Mills, Maine

[73] Assignee: Scott Paper Company, Philadelphia, Pa.

[22] Filed: July 23, 1969

[21] Appl. No.: 844,186

[52] U.S. Cl. ..... 96/1 PC; 96/1.6; 96/1.5; 260/571; 260/574; 260/576; 260/577

[51] Int. Cl. ..... G03g 5/06; G03g 13/22

[58] Field of Search ..... 96/1.5, 1.6; 260/571, 260/574, 576, 577; 252/501

[56] References Cited

UNITED STATES PATENTS

| | | | |
|---|---|---|---|
| 3,141,770 | 7/1964 | Davis et al. | 252/501 X |
| 3,180,730 | 4/1965 | Klupfel et al. | 96/1.5 |
| 3,265,497 | 8/1966 | Kosche | 96/1.5 |
| 3,624,226 | 11/1971 | Hoover et al. | 96/1.5 |

OTHER PUBLICATIONS

Jour. Am. Chem. Soc., 1948, vol. 70, pp. 680–684.

*Primary Examiner*—George F. Lesmes
*Assistant Examiner*—R. E. Martin
*Attorney, Agent, or Firm*—John W. Kane, Jr.; William J. Foley; John A. Weygandt

[57] ABSTRACT

An electrophotographic element comprised of a slightly conductive support and an insulating coating thereon comprised of an insulating resin and a substituted aniline photoconductor. An electron acceptor sensitizing agent can also be added to the insulating coating.

17 Claims, No Drawings

PHOTOCONDUCTOR ELEMENTS CONTAINING SUBSTITUTED ANILINE PHOTOCONDUCTOR COMPOUNDS

BACKGROUND OF THE INVENTION

This invention relates to photographic reproduction and more particularly to a new electrophotographic element and to an electrophotographic process utilizing the new electrophotographic element. The electrophotographic process is a process in which an electrostatic latent image is produced by utilizing the property of photoconduction, i.e., variable conductivity dependent on the intensity of illumination. In the process an electrophotographic element is given a surface charge. The surface is then selectively exposed to light whereupon the surface charge dissipates from the surface at varying rates depending upon the intensity of illumination. The dissipation of the charge results from the conductive properties of the exposed photoconductor compound. The electrostatic latent image (nonvisible electrostatic charge pattern) may be produced in a conventional exposure operation, for example, by means of a lens-projected image or by contact-printing techniques.

The latent image so produced is developed, i.e., rendered visible, by means of a triboelectric powder or liquid toner. The triboelectric powder consists of a visible pigment and a fusable resinous compound. The triboelectric powder collects in the image areas and is fused into place by heating the resinous component of the powder. In developing an image with liquid toner, the liquid toner, which contains charged particles and a drying oil component, is washed over the surface of the exposed electrophotographic element. The charged particles are either attracted to or repelled by the latent image areas, depending upon the charge on the particles and the charge on the surface of the electrophotographic element and are bonded to the surface of the element as the drying oil component polymerizes. The surface of the electrophotographic element can be charged either positively or negatively and the toner can be charged either positively or negatively thereby giving four combinations of surface charge and toner charge to be utilized in producing the imaged product.

In electrophotographic processes the electrostatic latent image is commonly formed on the surface of a photoconductive insulating layer carried on a support. For example, material comprising such support and photoconductive layer is charged either positively or negatively by conventional means such as a corona discharge or the like to produce a uniform surface charge on the photoconductive support. Due to the substantial insulating character, i.e., the low conductivity of the insulating layer in the dark, the charge is retained by the photoconductive support. The photoconductive element is then exposed through an image bearing transparency or by reflex. This exposure activates the photoconductive compound thereby increasing the conductivity of the insulating layer in the exposed areas and allowing the charge to dissipate in these areas. The extent of this dissipation is directly proportional to the intensity of illumination or exposure. Thus, the charge in the activated or exposed areas is dissipated while the unexposed areas remain charged. The charge density at any point within the charge pattern is proportional to the intensity of illumination to which that point is subjected during the exposure. Thus, electrostatic latent images may consist of a pattern of varying charge densities depending upon the exposure conditions. This pattern of varying charge densities is rendered visible through the use of variously charged powders or toners as previously described.

The electrophotographic processes have become of increasing importance in recent years, especially in connection with office duplicating processes. Consequently, much interest has been aroused and great effort expended to obtain suitable materials for preparing the support and photoconductive insulating layers used in such copying processes.

Particular efforts have been expended to develop colorless organic photoconductors as a white copy sheet is generally preferred. Problems, however, have been encountered in obtaining colorless photoconductors that are sufficiently sensitive to be imaged using known light sources without, at the same time, being severely discolored by the interaction of light and oxygen.

It is, therefore, the major objective of the present invention to provide a new group of colorless organic photoconductors that do not become appreciably discolored when exposed to light and oxygen. The invention is also directed to a new electrophotographic material which is quickly and easily imaged by exposure to commonly employed light sources. Furthermore, the photoconductors of the present invention can be practically employed at low concentrations as opposed to other known photoconductors which, while they may exhibit electrophotographic responses at low concentrations, cannot practically be employed in photoconductive elements at the same low concentrations.

PRIOR ART

In recent years many investigations have been made with respect to the nature of suitable photoconductive materials. Most notable among the photoconductive substances hitherto used in electrophotographic processes have been inorganic materials such as zinc oxide and selenium.

However, within the last few years the search for suitable photoconductors has been broadened to include organic chemical compounds and polymers. As a result of these searches several classes of organic compounds have been found to be useful as photoconductors; included in this group are the 2,5-bis(p-aminophenyl)-1,3,4-oxadiazoles, U.S. Pat. No. 3,189,447; 2-aryl-4-arylidene oxazolones, U.S. Pat. No. 3,072,479; substituted Schiff bases, U.S. Pat. No. 3,041,165; aryl-substituted-p- and m-phenylenediamines, U.S. Pat. Nos. 3,314,788; 3,141,770 and 3,265,496; N-disubstituted benzylideneazines, U.S. Pat. No. 3,290,147 and various other compounds, see Great Britain Pat. No. 895,001. The photoconductors of the present invention can be employed at lower concentrations than can most known organic photoconductors.

DESCRIPTION OF THE INVENTION

The new electrophotographic material of the present invention is comprised of a conductive support layer having coated on at least one surface thereof, a photoconductive insulating layer; said photoconductive insulating layer comprising an insulating resinous binder and at least one of the organic photoconductors selected from the group of substituted aniline compounds corresponding to one of the formulas

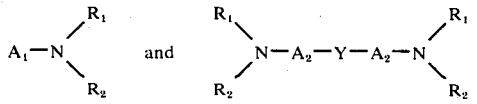

wherein $A_1$ represents alkoxyphenyl, alkylthiophenyl, phenoxyphenyl, phenylthiophenyl, benzyloxyphenyl or benzylthiophenyl; $A_2$ represents phenylene or substituted phenylene; Y represents oxo, thio, dithio or sulfonyl; $R_1$ represents alkyl, benzyl, and substituted benzyl; $R_2$ independently represents a member of $R_1$. In the present specification and claims the terms "alkyl", "alkoxy" and "alkylthio" represent alkyl, alkoxy and alkylthio moieties containing from 1 to 4 carbon atoms, inclusive. The terms "alkoxyphenyl" designates a phenyl moiety bearing one or two alkoxy substituents and from 0 to 2 halo or methyl substituents or mixture of halo and methyl substituents with, of course, any positions not bearing alkoxy, halo or methyl moieties being substituted with a hydrogen atom. The term "alkylthiophenyl" represents a phenyl moiety bearing one or two alkylthio substituents and from 0 to 2 halo or methyl substituents or mixture of halo and methyl, with any positions not bearing alkylthio, halo or methyl moieties bearing hydrogen.

Representative alkoxyphenyl and alkythiophenyl moieties include 2,5-dimethoxyphenyl; 2,5-diethoxyphenyl; 4-methoxyphenyl; 3-methoxyphenyl; 4-chloro-2,5-diethoxyphenyl; 3-chloro-2,4-diethoxyphenyl; 4-bromo-2,5-dimethoxyphenyl; 3-bromo-2,4-dimethoxyphenyl; 4-chloro-3-methoxphenyl; 3-bromo-4-ethoxyphenyl; 4-chloro-3-ethoxyphenyl; 5-chloro-4-ethoxy-2-methylphenyl; 2-chloro-4-methoxy-5-methylphenyl; 2,5-dimethyl-4-methoxyphenyl; 2,5-dimethyl-4-ethoxyphenyl; 2,5-dichloro-4-methoxyphenyl; 2,6-dibromo-4-methoxyphenyl; 2,5-dimethyl-4-methylthiophenyl; 2,3,5,6-tetrachloro-4-methylthiophenyl; 4-ethylthio-2,5-dimethylphenyl; 4-ethylthiophenyl; 4-ethylthio-2,5-dimethylphenyl; 3-chloro-6-methyl-4-methylthiophenyl.

The term "substituted phenylene" designates 1,4-phenylene having from 0 to 4, inclusive, halo or methyl substituents or mixtures of halo and methyl groups; said substituents being at positions other than the 1 and 4 positions. Representative substituted phenylenes include 2,5-dichloro-1,4-phenylene; 3-chloro-1,4-phenylene; 3-methyl-1,4-phenylene; 2,3,5,6-tetramethyl-1,4-phenylene; 2,3,5,6-tetrachloro-1,4-phenylene; 2,5-dimethyl-1,4-phenylenes; 2,3,5-trimethyl-1,4-phenylene; 2,3,6-trichloro-1,4-phenylene and 2,3,6-trimethyl-1,4-phenylene.

The terms "phenoxyphenyl", "phenylthiophenyl", "benzyloxyphenyl" and "benzylthiophenyl" represent a radical corresponding to the formula

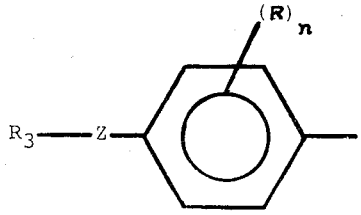

wherein R represents halo or methyl; Z represents oxo or thio; $R_3$ represents phenyl, benzyl, substituted phenyl or substituted benzyl and *n* represents one of the integers 0, 1, 2, 3, or 4.

The terms "substituted phenyl" and "substituted benzyl" as employed in the present specification and claims refer to mono- or polysubstituted phenyl and benzyl moieties having from 1 to 5, inclusive, substituents selected from halo, lower alkyl or mixtures of halo and alkyl substituents. Representative substituted phenyl and substituted benzyl moieties include 2,3,4,5,6-pentachlorophenyl; 2,3,4,5,6-pentabromobenzyl; 2,4,5,6-tetrachlorobenzyl; 2,4,5,6-tetrabromobenzyl; 2,3,4,5,6-pentamethylphenyl; 2,3,4,5,6-pentamethylbenzyl; 2,4-diethylphenyl; 2,4,6-trimethylbenzyl 4-n-butylbenzyl; 4-isopropylphenyl; 3-ethylbenzyl; 4-ethyl-2-chlorophenyl 2,5-dibromo-4-methylphenyl; 2,3,5,6-tetramethyl-4-chlorophenyl; 2,5-diethyl-3-chlorobenzyl; 2,3,5,6-tetrachloro-4-n-butylphenyl; 4-bromophenyl; 3-bromobenzyl; 2,3,5-trichlorophenyl; 2,3,6-trichlorophenyl; 2,4-dimethylbenzyl; 2,3,4,5,6-pentamethylphenyl; 2,3,4,5,6-pentachlorophenyl; 2,3,5,6-tetramethylbenzyl; 2,3,4,5,6-pentamethylbenzyl; 2,3,5,6-tetrachlorophenyl; 3-chloro-4-methylphenyl; 3-bromophenyl; 2,4-dichlorophenyl; 2,5-dimethylbenzyl; 2,5-dimethylphenyl; 3,4-dichlorophenyl; 2,3,6-trichlorophenyl; 2,4,6-trimethylphenyl; 3,4-dibromophenyl and 3,5-dibromobenzyl and the like.

For the sake of convenience, the term "photoconductor compound" will be employed in the present specification and claims to designate one of the substituted aniline compounds of the present invention or a mixture of such compounds.

The photoconductor compounds generally absorb the lower end of the ultra-violet spectrum (i.e., about 3300 A and below). The spectral response of the photoconductor compounds and thus the spectral response of the electrophotographic product of the present invention, however, can be shifted to a longer wave length by incorporating an electron accepting sensitizing agent into the photoconductive layer along with the photoconductor compound. In addition to shifting the spectral response the electron accepting sensitizer facilitates mobile charge carrier transport, thereby increasing the efficiency of the system. Representative sensitizers are the substituted fluorene compounds such as 9-fluorenone; 2,4,7-trinitro-9-fluorenone and 2-nitrofluorenone; substituted stilbenes such as 2,4,3'-trinitrostilbene; 2,4-dinitrostilbene; and 2,4,6-trinitrostilbene; substituted benzothiazoles such as 2-styrylbenzothiazole; 3-nitrophenylbenzothiazole; 2-phenylbenzothiazole; 2-(3'-nitrophenyl)benzothiazole; 2-(4'-dimethylamino)benzothiazole; and 4-phenylbutadienyl-2-benzothiazole; and other sensitizers such as 2-styrylquinoline; p-nitroacetophenone; 1,1-dicyano-4-phenylbutadiene; 9,10-phenanthrenedione; 3,5-dinitromethylbenzoate; 2,4-dinitrophenyl sulfide; 2,4,4'-trinitrodiphenyl ether; bis(3-nitrophenyl)disulfide; bis(4-chloro-2-nitrophenyl)-disulfide; cyanine dyes such as Orthochrome T; Genacryl orange; pinacyanol, indocarbocyanine; Kryptocyanine; and ethyl red. Triphenyl methane dyes such as crystal violet and malachite green are also functional. A preferred group of sensitizers include 9,10-phenanthrenedione; genacryl orange and crystal violet with 9,10-phenanthrenedione being the most preferred.

In addition to the photoconductor compound and sensitizer, if one is employed, the photoconductive insulating layer contains an insulating resinous binder. The term "insulating resinous binder" refers to natural or synthetic resins or synthetic polymers, for example, natural resins such as rosin; modified natural resins such as cellulose derivatives and chlorinated rubbers; synthetic resins (including copolymers) such as the polystyrenes or polystyrene copolymers including styrene-butadiene; acrylates; polyvinyl acetals; polycarbonates; polyphenylene oxide; phenoxy resins; polysulfones; polyesters and other synthetic polymeric resinous materials. Mixtures of resins or synthetic polymers can also be utilized. The resinous material is conveniently dispersed in a solvent suitable for the particular resin and the photoconductor compounds blended therewith. The photoconductor compound and sensitizer, if one is employed, are conveniently admixed directly into the resin solution. Representative solvent carriers in which the photoconductor and resin are dispersed include benzene, chloroform, acetone, toluene, methylene chloride, methylethyl ketone or mixtures thereof. The photoconductor compound or mixtures of two or more photoconductor compounds of the present invention can be employed is association with other organic photoconductive substances. The dispersion of insulating resinous binder, photoconductor compound and sensitizer is then applied to the support material.

In preparing the photoconductive insulating layer of the electrophotographic element of the present invention, the photoconductor compound is generally employed in an amount equivalent to from about 5 to 200 or more percent by weight with respect to the resinous binder. In many cases the photoconductor compound or mixture thereof may be employed at greater than 100 percent with advantageous results. The amount of photoconductor compound to be employed will depend upon the system in which the electrophotographic element is being utilized, i.e., the light source used to expose the electrophotographic element, the length of exposure, the resinous binder, sensitizer, etc., and the particular photoconductor compound. The amount to be employed will, however, generally be within the above defined range; in some cases, however, it may be desirable to employ the photoconductor compound in amounts substantially above 200 percent.

The amount of electron-acceptor sensitizing agent to be utilized will vary depending upon such factors as the particular sensitizer being employed, the photoconductor compound, the light source and the length of exposure. The photoconductor compounds of the present invention can be employed with good results at about 3300 A or below without using a sensitizer. However, it is generally desirable to employ a sensitizer to shift the spectral response. In such cases the amount employed will be within the range of from about 0.05 to about 3 percent by weight of the photoconductor compound.

The support to which the photoconductive insulating layer is applied can be of any material suitable for use in electrophotographic processes, for example, aluminum or other metal plates or foil, plastic foil, and preferably paper sheets or webs. When paper is to be used as a support for the photoconductive layer, it is preferable to pretreat the paper to prevent penetration by the solvent used to disperse the resinous binder and for photoconductor compound. The following well known barrier coat compositions can be employed: methyl cellulose in aqueous solution; polyvinyl alcohol in aqueous solution; a solution in acetone and methyl ethyl ketone of a mixed polymer of acrylic acid methyl ester and acrylonitrile; solutions of polyamides in aqueous alcohols or a coating containing some conductive polymer such as polyvinyl benzyl-trimethylammonium chloride.

In producing the electrophotographic element, a dispersion of the photoconductive compounds and insulating resinous binders in an organic solvent carrier is applied to the support by known methods (for example, by spraying, reverse roll coating, or whirl coating). While the photoconductive insulating layer is conveniently applied as a solvent dispersion, the photoconductor compound and sensitizer can be dispersed in the insulating binder without the use of solvents and the insulating layer can be formed by common film forming techniques such as extruding, hot melt and the like. Following the coating procedure, the coating thus prepared is dried by conventional means.

Prior to exposure the photoconductive layers are charged positively or negatively, usually by means of a corona discharge. The light sensitivity of the photoconductive layers produced in accordance with the teachings of the present specification lie mainly in the range of 3,000 to 7,500 A. very good latent images may be obtained by a short exposure through a positive or negative transparency to a conventional electrophotographic light source such as a high pressure mercury vapor lamp, tungsten lamp or the like. The latent image so produced may be developed in known fashion by the application of dry powder or liquid toner.

The following examples are merely illustrative and are not deemed to be limiting.

SPECIFIC EXAMPLES

Example 1

A photoconductive insulating coating was prepared by mixing together 24 grams polystyrene solution ( 1 g., polystyrene per 10 ml. $CH_3Cl$), N,N-di(4-methylbenzyl)-4-thiomethylaniline (1.0 g) and 9,10-phenanthrenedione (0.25 ml). The coating composition thus prepared was applied by means of a Meyer bar to one side of a paper base stock (34 pounds/ream — 500 sheets — 25 × 38 inches) having on each side thereof a 10 pound base coating of clay, titanium dioxide, polyvinyl alcohol and electrically conductive polyvinylbenzyltrimethyl ammonium chloride. The photoconductive insulating coating was applied in an amount equivalent to 4 pounds dry weight of coating per ream (25 × 38 inches — 500 sheets). The sheet was negatively charged by means of a corona discharge. A good clear image was produced upon exposure through a positive transparency to a 200 watt high pressure mercury light source (microfilm projection exposure) for 15 seconds. The latent image was developed using a standard, commercial liquid toner (Pram PL-44N, sold by Pram Toner Co.) The image and photoconductive composition were very stable showing barely discernable discoloration after 30 minutes in a Fade-ometer.

In another operation, a photoconductive coating containing only 0.15 grams of N,N-di(4-methylbenzyl)-4-methylthioaniline, 9,10-phenanthrenedione (0.25 ml) and 24 grams of polystyrene solution as described in paragraph 1 was prepared and coated on identical body stock using the amounts and methods as previously described. The photographic element thus prepared upon exposure to the same light source for 5 seconds and subsequent development as previously described produced a clear image which did not discolor appreciably when placed in the Fade-ometer for 30 minutes.

Example 2

N,N-dibenzyl-4-phenoxyaniline (0.5 g) was dissolved in 20 grams of a polymer solution comprised of 20 grams of polystyrene (Styron 666U - The Dow Chemical Company) dissolved in 200 milliliters of chloroform. The coating composition was mixed thoroughly and thereafter applied to the base sheet described in Example 1 by means of No. 18 Meyer bar. The coating was then dried, given a negative charge by means of a corona discharge and imaged through a positive transparency by means of a high-pressure mercury vapor lamp as described in Example 1 for a period of 10 seconds. The imaged surface was then treated with a standard, commercial liquid toner to produce a good clear image. A sample of the paper thus produced was placed in the Fade-ometer for 30 minutes with only very slight discoloration.

Example 3

An electrophotographic coating composition was prepared by dispersing N,N-di-(4-methylbenzyl)-4-methylthioaniline (1 g) and 9,10-phenanthrenedione (0.005 g) in 24 grams of a polysulfone solution comprising 1 gram of polysulfone (P-1700 sold by Union Carbide Corporation) per 100 milliliters of $CH_3Cl$. The coating composition thus prepared was applied to a suitable paper substrate which has been base coated with 4 pounds (dry weight) per ream (25 × 38 inches — 500 sheets) of a coating comprised of 70 parts by weight of polyvinyl alcohol, 20 parts by weight of calcium carbonate and 10 parts by weight of polyvinylbenzyltrimethyl ammonium chloride.

A positive print was made by negatively charging the photoconductor element by means of a corona discharge and subsequently exposing the element through a positive transparency to a high pressure mercury light source at 40 cm. for 5 seconds.

The latent electrostatic image thus produced was developed by applying thereto a dry, positively charged thermoplastic resinous toner (comprising carbon black particles coated with thermoplastic resin). The toner thus applied was attracted to the latent image areas producing a visible image that was permanently fixed by heating the thermoplastic toner on the surface of the photoconductor element at a temperature of 100° – 130° C for a short time to solidly fuse the toner.

The clear print thus prepared showed no appreciable discoloration when placed in a Fade-ometer for 30 minutes.

In another variation of the procedures of this example, all steps are repeated as described above except that the coated photoconductor element is positively charged, and the developing toner is negatively charged. Clear images are produced when the positively charged photoconductor element is developed with the negative toner.

It is a unique characteristic of the coatings of the present invention that in addition to the clear image obtained by oppositely charged electrophotographic elements and toner, excellent results are obtained by employing sheets and toner having like charges. A positively charged photoconductor element and positive toner are employed in one variation, and a negatively charged photoconductor element and negative toner in yet another. Both of these like charged combinations produce clear, sharp, positive images with no appreciable discoloration in light for substantial periods of time.

Example 4

A coating composition is prepared by dispersing 1 part by weight of N,N,N,′,N′-tetramethyl-4,4-dithiodianiline, 3 parts by weight of polyvinyl butyral (Butvar B-76, sold by the Monsanto Chemical Company) as a resinous binder and 10 parts by weight of ethyl red (sensitizing dye) in 15 parts by weight of chloroform as a solvent for the above composition.

This coating composition is applied to one side of a web of bleached paper bodystock having a basis weight of 40 pounds per ream, and previously coated with 8 pounds (dry weight) per ream of the base coating described in Example 1. The photoconductor element thus produced is negatively charged by means of a corona discharge, and the charged element exposed through a positive transparency to a 60 watt tungsten lamp at a distance of 22 cm. for 15 seconds.

The latent image thus produced in selected areas of the surface of the element is developed by applying to the exposed surface of the element a positively charged liquid toner comprised of an oxidizing oil which has been intimately admixed with a colored material such as carbon black, dispersed in strongly insulating liquid such as deodorized kerosene. The particles of oil and carbon black are attracted to the latent image areas in the exposed sheets, and a clear, sharp visible image is produced. No heat fusing step is necessary in this method as the oil quickly hardens on exposure to the air and adheres permanently to the surface of the print.

The print thus produced is placed in a Fade-ometer for 60 minutes with only very slight discoloration.

Example 5

A series of photoconductor elements were prepared by dispersing a photoconductor compound and sensitizer in a binder composition comprised of 1 gram of polystyrene per 10 milliliters of chloroform. The particular photoconductor compound employed, the amount of photoconductor and the amount of sensitizer, expressed as percentage of the amount of photoconductor, employed in the various formulations are set forth in Table I. In each case, the photoconductor containing solution was spread on a paper base sheet by means of a No. 20 Meyer bar in an amount sufficient to provide a coating of about 3 to 4 pounds, dry weight, of photoconductor composition per ream. Thereafter, the coating was dried and the electrophotographic element negatively charged by means of a corona discharge and exposed to a 200 watt mercury light source through a positive transparency for a period of 10 seconds. The latent image was developed as described in Example 1. As a result of these operations each of the photoconductor elements produced from the formulations listed in Table I produced an acceptable image.

TABLE I

| Photoconductor | Amount of Photoconductor by Weight | Sensitizer and Amount As A Weight Percentage Of The Amount of Photoconductor |
|---|---|---|
| N,N-di(2-methylbenzyl)-4-phenoxyaniline (m.p. 134°–137°C) | 0.13 g | ½% phenanthrenequinone |
| N,N-dibenzyl-4-phenoxyaniline (m.p. 107°–109°C) | 0.25 g | ½% phenanthrenequinone |
| N,N-o-xylylidene-4-phenoxyaniline (m.p. 180°–184°C) | 0.25 g | ½% phenanthrenequinone |
| N,N-di(4-chlorobenzyl)-4-phenoxyaniline (m.p. 79°–83°C) | 0.25 g | ½% phenanthrenequinone |
| N,N,O-tri(2,5-dimethylbenzyl)-4-aminophenol (m.p. 115°–116°C) | 0.13 g | ½% phenanthrenequinone |
| N,N,O-tri(2-methylbenzyl)-4-aminophenol (m.p. 82°–83°C, then at 91°C) | 0.25 g | ½% phenanthrenequinone |
| N,N,O-tribenzyl-4-aminophenol (m.p. 84°–85°C) | 0.60 g | 1% styrylbenzothiozole |
| N,N,O-tribenzyl-4-aminophenol (m.p. 84°–85°C) | 0.13 g | ½% phenanthrenequinone |
| N,N-dibenzyl-4-methoxyaniline (m.p. 83°C) | 0.13 g | ½% phenanthrenequinone |
| N-benzyl-N-(2,5-dimethylbenzyl)-4-methoxyaniline (m.p. 49°–51°C) | 0.25 g | ½% phenanthrenequinone |
| N,N-dibenzyl-4-ethoxyaniline (m.p. 55°–57°C) | 0.25 g | ½% phenanthrenequinone |
| N,N-di(4-methylbenzyl)-4-phenoxyaniline (m.p. 134°–137°C) | 0.13 g | ½% phenanthrenequinone |
| N,N-di(4-methylbenzyl)-4-thiomethylaniline (m.p. 70°–73°C) | 0.075 g | 15% phenanthrenequinone |
| N,N-di(2-methylbenzyl)-4-thiomethylaniline (m.p. 98°–104°C) | 0.13 g | ½% phenanthrenequinone |
| N,N-dibenzyl-2,5-diethoxyaniline (m.p. 59°–61°C) | 0.25 g | ½% phenanthrenequinone |
| N,N-dibenzyl-3-chloro-4-methoxy-6-methylaniline (m.p. 100°–109°C) | 0.25 g | ½% phenanthrenequinone |
| N,N-dibenzyl-5-chloro-4-methoxy-2-methylaniline (m.p. 100°–109°C) | 0.33 g | ½% phenanthrenequinone |
| N,N-benzyl-4-(4-tolylthio)aniline (m.p. 87.5°–90°C) | 0.25 g | ½% phenanthrenequinone |
| N,N,N'N'-tetramethyl-4,4'-oxydianiline (m.p. 75°–85°C) | 0.25 g | ½% phenanthrenequinone |
| N,N,N',N'-tetrabenzyl-4,4'-oxydianiline (m.p. 115°–117°C) | 0.33 g | ½% phenanthrenequinone |
| N,N,N',N'-tetrabenzyldithiodianiline (m.p. 142°–144°C) | 0.33 g | ½% phenanthrenequinone |
| N,N-dibenzyl-2,5-dimethoxy-4-chloroaniline (m.p. 74°–76°C) | 0.33 g | ½% phenanthrenequinone |
| N,N,N',N'-tetrabenzyl-4,4'-sulfonyldianiline (m.p. 193°–195°C) | 0.33 g | ½% phenanthrenequinone |
| N-benzyl-N-(2,5-dimethylbenzyl)-4-methoxyaniline (m.p. 49°–51°C) | 0.33 g | ½% phenanthrenequinone |
| N-benzyl-N-(2-methylbenzyl)-4-methoxyaniline (m.p. 53°–55°C) | 0.33 g | ½% phenanthrenequinone |
| N,N,N',N'-tetramethyl-4,4'-thiodianiline (m.p. 120°–123°C) | 0.33 g | ½% phenanthrenequinone |

The following photoconductor compounds have also been tested in accordance with the method of the present invention and have been found to be useful photoconductor compounds and to be useful for producing the photoconductive compositions and elements of the present invention.

N,N-dibenzyl-4-ethylthioaniline (m.p. 64°–68° C)
N,N-dibenzyl-4-phenylthioaniline (m.p. 109°–111° C)
N,N-di(3,4-dichlorobenzyl)-4-methoxyaniline (m.p. 89°–91° C)
N,N-di(2-chlorobenzyl)-4-methoxyaniline (m.p. 146°–149° C)
N,N-di(4-methylbenzyl)-4-methoxyaniline (m.p. 84°–87° C)
N,N-di (2,5-dimethylbenzyl)-4-methyloxyaniline (m.p. 91°–93° C)
N,N-di(4-chlorobenzyl)-4-methoxyaniline (m.p. 94°–96° C)
N,N-di(2,4-dichlorobenzyl)-4-methoxyaniline (m.p. 126°–128° C)
N,N-dibenzyl-3-methoxyaniline (m.p. 50°–53° C)
N,N-di(2,3,5,6-tetramethylbenzyl)-4-phenoxyaniline (m.p. 128°–136° C)
N,N-dibenzyl-4-methylthiobenzyl (m.p. 91°–95° C)
N,N-di(2-methylbenzyl)-4-methoxyaniline (m.p. 119°–121° C)
N,N-di(2,5-dimethylbenzyl)-4-ethoxyaniline (m.p. 115°–116° C)
N,N-di(2-methylbenzyl)-4-ethoxyaniline (m.p. 106°–108° C)
N,N-di(4-methylbenzyl)-4-ethoxyaniline (m.p. 109°–111° C)
N,N-di(2-chlorobenzyl)-4-ethoxyaniline (m.p. 112°–114° C)
N,N-di(4-chlorobenzyl)-4-ethoxyaniline (m.p. 79°–81° C)
N,N-dibenzyl-4-n-butoxyaniline (m.p. 51°–52° C)
N,N-dibenzyl-4-(4-methylphenoxy)aniline (m.p.62°–64° C)
N,N-dibenzyl-2,5-dimethoxyaniline (m.p. 72.5°–74° C)
N,N-dimethyl-4-(4-methylphenyl)thioaniline (m.p. 87.5°–90° C)
N,N,N',N'-tetra(4-methylbenzyl)-4,4'-dithiodianiline (m.p. 153°–155° C)
N,N,O-trimethylaniline (m.p. 48° C)
N,N-dimethyl-4-ethoxyaniline (m.p. 37° C)
N,N-dimethyl-2,4-dimethoxy-5-chloroaniline (m.p. 42°–44° C)

N,N,S-trimethyl-4-aminothiophenol (m.p. 19°–20° C)

N,N,N,',N'-tetramethyl-4,4'-dithiodianiline (m.p. 100°–102° C)

The preferred photoconductor compounds are selected from the aniline derivatives corresponding to one of the formulas

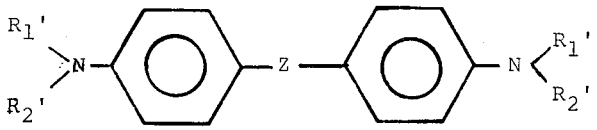

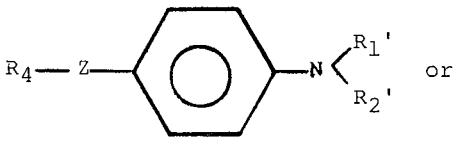

or

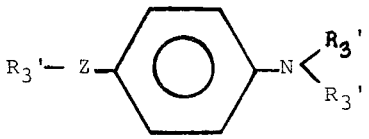

with 4,4'-oxydianiline derivatives and the 4,4'-thiodianiline derivatives corresponding to the formula

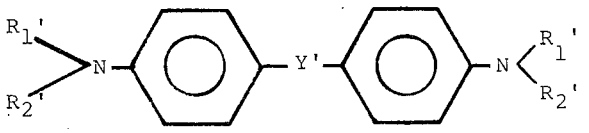

being the most preferred photoconductor compounds. In the preferred embodiments, the term Z represents oxo or thio; $R_1'$ represents benzyl, methyl, or ethyl and $R_2'$ independently represents $R_1'$; $R_4$ represents methyl or ethyl and $R_3'$ represents benzyl or methyl substituted benzyl.

Representative preferred compounds include N,N,O-trimethyl-4-aminophenol; N,N-dibenzyl-4-methoxyaniline; N,N-dibenzyl-4-ethoxyaniline; N,N,S-tribenzyl-4-aminothiophenol; N,N,O-tri(2,5-dimethylbenzyl)-4-aminophenol; N,N,S-tri(2,5-dimethylbenzyl)-4-aminothiophenol); N,N-di(4-methylbenzyl)-4-methoxyaniline; N,N-dibenzyl-4-ethylthioaniline; N-benzyl-N-(2,5-diemthylbenzyl)-4-methoxyaniline; N,N,O-tri(2-methylbenzyl)-4-aminophenol; N-benzyl-N-(2,5-dimethylbenzyl)-4-methylthioaniline; N,N,S-tri(2,5-dimethylbenzyl)-4-aminothiophenol; N,N-di(4-methylbenzyl)-4-methylthioaniline; N,N-dibenzyl-4-(4-tolylthio)-aniline; N,N-di-(2-methylbenzyl)-4-thiomethylaniline; N-benzyl-N-(2-methylbenzyl)-4-methoxyaniline; N,N-di(2-methylbenzyl)-4-methoxyaniline; N,N-di(2-methylbenzyl)-4-ethoxyaniline; N-benzyl-N-(2-methylbenzyl)-4-methoxyaniline; and N-benzyl-N-(2,5-dimethylbenzyl)-4-ethoxyaniline. Representative most preferred photoconductor compounds include N,N,N',N'-tetrabenzyl-4,4'-oxydianiline; N,N,N',N'-tetrabenzyl-4,4'-thiodianiline; N,N,N',N'-tetramethyl-4,4'-oxydianiline; N,N,N',N'-tetramethyl-4,4'-thiodianiline; N,N,N',N'-tetra(2,5-dimethylbenzyl)-4,4'-oxydianiline and N,N,N',N'-tetra(2-methylbenzyl)-4,4'-thiodianiline.

The photoconductor compounds of the present invention having benzyl or substituted benzyl substituents on the N, O or S atoms are prepared in accordance with known benzylation techniques. In a representative procedure, benzylation is accomplished by reacting a benzyl halide or substituted benzyl halide with an amine compound corresponding to one of the formulas

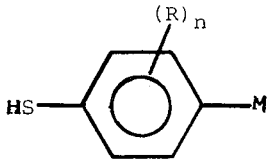

,

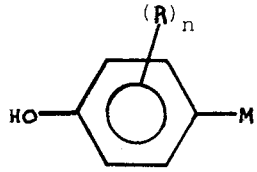

, $R_3$— Y —$A_2$—M or

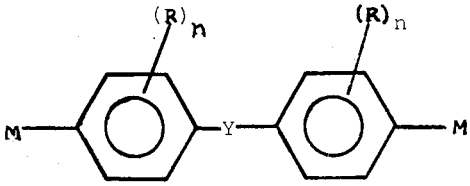

where M represents —$NH_2$ or —$NHR_1$ and R, $R_1$, $A_2$, Y and n are all as previously defined. The reaction between the amine compound and benzyl halide takes place readily in an inert organic solvent as reaction medium and at temperatures within the range of from 40° to 150° C with the production of the desired photoconductor compound and the hydrogen halide of reaction. The temperature of the reaction mixture is maintained within the reaction temperature range for from 1 to 4 hours and conveniently until there is a substantial cessation in the production of the hydrogen halide of reaction. The proportions of the reactants to be employed are not critical, some of the photoconductor compound being formed when the reactants are contacted together in any proportions. However, in a preferred procedure, the benzyl halide or substituted benzyl halide is employed in an amount slightly in excess (about 10 percent) of the stoichiometric amount required to benzylate the particular starting material. The stoichiometric amount required, of course, can be easily determined by multiplying the molar amount of amine starting material by the number of amine, hydroxy or thio-hydrogens to be replaced. In a convenient procedure, a base such as sodium hydroxide or potassium hydroxide is added to the reaction mixture to prevent formation of the hydrohalide salt of the amine starting material.

Following the reaction period, the desired photoconductor compound can be isolated from the reaction mixture by conventional procedures. In a convenient procedure, the oily product is separated by decantation or other such conventional means and thereafter dissolved in an organic solvent such as acetone. The solvent solution is filtered to remove the salt byproduct formed during the neutralization procedure and cooled. During the cooling proceudre, the product separates as an oil, non-crystalline solid or crystalline solid. This product can then be further purified by such conventional procedures as washing, crystallization, distillation or recrystallization.

The following representative procedures illustrate the preparation of the photoconductor compounds of the present invention.

P-(methylthio)aniline (13.9 g., 0.10 mole) and p-methylbenzyl chloride (35.2 g., 0.25 mole) were heated on the hot plate with stirring in 50 milliliters of isopropanol for 5 hours. During the heating period NaOH was added to the reaction mixture with the resultant production of the sodium chloride salt reaction by-product. Following the heating period, the reaction mixture was filtered while hot to remove the sodium chloride byproduct. Thereafter, the reaction mixture was allowed to cool with the desired product precipitating in the reaction mixture during the cooling procedure. This precipitate was collected by filtration and recrystallized from an acetone-alcohol with the mixture being cleaned with activated charcoal. The cleaned recrystallized N,N-di(4′-methylbenzyl)-4-methylthioaniline product was found to melt at 70°–73° C.

P-anisidine (49.3 g., 0.4 mole), benzyl chloride (126.5 g., 1.0 mole) and 200 milliliters of ethanol were mixed together. The resultant solution had a magenta color indicating an acidic solution. The reaction mixture was heated slightly to start the reaction; however, the exothermic reaction soon provided enough heat to cause the reaction mixture to boil steadily without the addition of heat. The temperature of the reaction mixture was allowed to remain at the reflux temperature for about 1 hour. During the reflux period the reaction mixture was stirred continuously and sodium hydroxide added gradually. Following the reflux period the reaction mixture was chilled to induce formation of a crystalline product. The reaction mixture was then rinsed successively with (1) 100 mls of ethanol, (2) 500 mls of water, (3) 200 mls of ethanol, (4) 500 mls of water, and finally (5) 200 mls of ethanol. The crude product thus obtained was dissolved in hexane, filtered while hot with 10 grams of activated charcoal, dried over $Na_2SO_4$ and then chilled to produce a crystallized N,N-dibenzyl-4-ethoxyaniline product melting at 80°–82° C.

P-phenoxy aniline (9.3 g., 0.05 mole), benzyl chloride (15.8 g., 0.125 mole) and 25 milliliters of isopropanol were admixed and heated for approximately 10 minutes. Following the heating period 4 grams of NaOH were added gradually to the reaction mixture over a period of about 1 hour. During the addition of the NaOH the reaction product separated from the reaction mixture as an oil which was washed with water. Chloroform was added to the aqueous oil product mixture to aid in the separation of the product and water. The water and chloroform were removed as an azeotrope by distillation under reduced pressure. The oily product was thereafter heated with acetone and chilled to induce crystallization and the resulting crystals isolated by filtration, washed with ethanol and dissolved in acetone and cleaned with activated charcoal. Following the cleaning procedure, the acetone solution was chilled to induce crystallization of the N,N-dibenzyl-4-phenoxyaniline product which upon drying was found to melt at 106°–109° C.

The 4-oxy and 4-thio compounds employed as starting materials in the production of the compounds of the present invention are known materials and are prepared in accordance with known methods. In a representative method, equimolar quantities (0.3 mole) of 4-chloronitrobenzene and a thiol or hydroxy compound corresponding to the formula $$A_3 — SH \text{ or } A_3OH$$

are mixed in 100 milliliters of dimethylsulfoxide. $A_3$ is as previously defined and, for example, is a phenyl moiety bearing from 0 to 2 halo or methyl substituents. Thereafter, 0.3 mole of potassium hydroxide is dissolved in a minimum amount of water and the solution added to the dimethylsulfoxide dispersion and the resulting reaction mixture is placed on a steam bath from 1 to 16 hours. The reaction proceeds with the production of the desired product and the potassium halide salt by-product. The reaction is conveniently continued until there is a substantial cessation in the production of the potassium halide salt whereupon water is added to the reaction mixture to dissolve the salt byproduct and precipitate the ether or thioether as a solid material. Nearly quantitative yields are common. The crude products are recrystallized from chloroform-ethanol to eliminate unreacted 4-chloronitrobenzene. The free amine is prepared from the nitro compound by typical reduction methods such as the use of tin or iron in hydrochloric acid.

The photoconductors of this application are then prepared from aniline by benzylation, alkylation or other methods herein described.

The photoconductor compounds corresponding to the formula

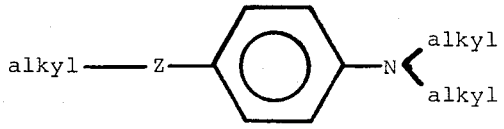

wherein Z represents oxy or thio are prepared by a procedure corresponding to the following synthesis employed to prepare N,N-dimethyl-O-ethyl-p-aminophenol. A 100 milliliter flask outfitted with a reflux condensor was charged with p-phenetidine (0.1 mole) and trimethyl phosphate. The flask and contents were heated until the reaction passed through an exotherm. When the reaction subsided heat was applied and the reflux maintained for about 20 minutes. At the end of the reflux period the reaction mixture separated into an oil and a solid phase. When the reaction mixture cooled sufficiently to be handled, 10% aqueous sodium hydroxide was added to hydrolyze the phosphate and the oil layer was collected, vacuum distilled and the constant boiling fraction collected and allowed to crystallize. The crystallized material was collected and recrystallized from ethanol and the N,N-dimethyl-4-ethoxyaniline found to have a melting point of 37° C.

The following photoconductor compounds to be employed in the present invention were prepared in accordance with the method just described.

a. N,N-dimethyl-2,4-dimethoxy-5-chloroaniline (boiled at 175° C at 20 mm., allowed to crystallize, recrystallized from hexane with the recrystallized product melting at 42°–44° C) was prepared from 2,4-dimethoxy-4-chloroaniline.

b. N,N,N′,N′-tetramethyl-4,4′-oxydianiline (boiled at 250° C at 20 mm., allowed to crystallize, recrystallized from hexane with the recrystallized product melting at 42°–44° C) was prepared from oxydianiline.

c. N,N-dimethyl-4-methylthioaniline was prepared from p-(methylthio)aniline. After the reaction period, the reaction mixture was cooled to room temperature whereupon the reaction mixture separated into an upper oil layer and a lower gelled phosphate layer. The oil layer was collected by decantation, distilled at 160° C (20 mm) and allowed to crystallize. The crystalline N,N-dimethyl-4-methylthioaniline product melted at 19°–20° C.

In other operations, photoconductor compounds corresponding to the formula

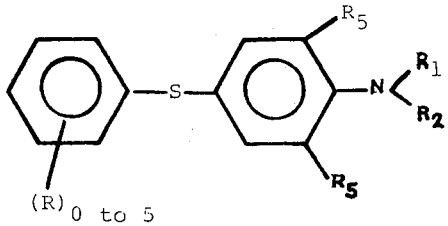

are prepared by reacting a substituted aniline corresponding to the formula

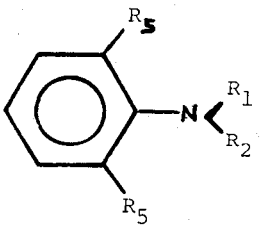

with an aromatic disulfide corresponding to the formula

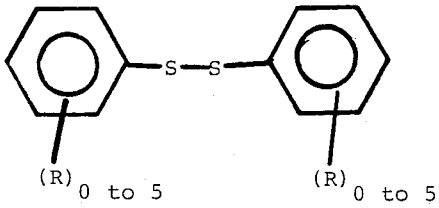

in an inert organic solvent such as carbon tetrachloride as the reaction medium. In carrying out the reaction, the aromatic disulfide is dissolved in an inert solvent and chlorine gas bubbled into the solution to prepare the sulfinyl chloride. The reaction mixture is then evaporated to dryness to remove the excess chlorine. The residue remaining after the low boiling constituents are evaporated is then resuspended in the inert solvent and the substituted aniline material added to the mixture. The mixture thus prepared is heated at the reflux temperature for several hours and allowed to cool whereupon the product generally precipitates as a solid residue. The solid aniline photoconductor product is separated by filtration or decantation, dissolved in a suitable organic solvent, washed with aqueous alkaline base, dried and crystallized. In those cases where the product does not precipitate when the reaction mixture is cooled the product can be collected by evaporating the low boiling constituents leaving the product as a residue which can then be collected and further purified as described.

I claim as my invention:

1. A new electrophotographic element comprising a conductive support layer having coated on at least one surface thereof, a photoconductive insulating layer; said photoconductive insulating layer comprising an insulating resinous binder and at least one of the organic photoconductors selected from the group of substituted aniline compounds corresponding to one of the formulas

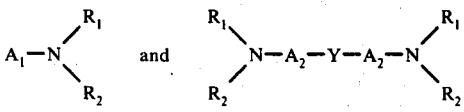

wherein $A_1$ represents alkoxyphenyl, alkylthiophenyl, phenoxyphenyl, phenylthiophenyl, benzyloxyphenyl or benzylthiophenyl; $A_2$ represents phenylene or substituted phenylene; Y represents oxo, thio, dithio or sulfonyl; $R_1$ represents alkyl, benzyl or substituted benzyl; and $R_2$ independently represents a member of $R_1$, with alkoxyphenyl designating a phenyl moiety bearing one or two alkoxy substituents and from 0 to 2 halo or methyl substituents or mixture of halo and methyl substituents with any positions not bearing alkoxy, halo or methyl moieties being substituted with a hydrogen atom, the term alkylthiophenyl designating a phenyl moiety bearing one or two alkylthio substituents and from 0 to 2 halo or methyl substituents or mixture of halo and methyl, with any positions not bearing alkylthio, halo or methyl moieties bearing hydrogen, substituted phenylene designating 1,4-phenylene moieties having from 0 to 4, inclusive, halo or methyl substituents or mixtures of halo and methyl groups and the terms phenoxyphenyl, phenylthiophenyl, benzyloxyphenyl and benzylthiophenyl representing a radical corresponding to the formula

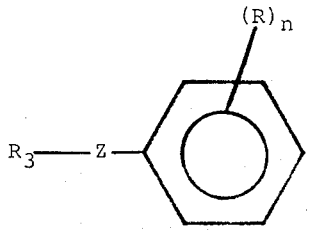

wherein R represents halo or methyl; Z represents oxo or thio; $R_3$ represents phenyl, benzyl, substituted phenyl or substituted benzyl and *n* represents one of the integers 0, 1, 2, 3 or 4.

2. The new electrophotographic element claimed in claim 1 wherein the photoconductor compound is selected from the group of substituted aniline compounds corresponding to one of the formulas

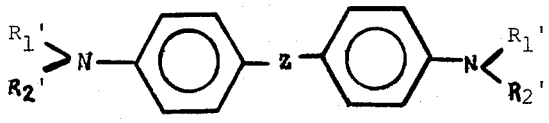

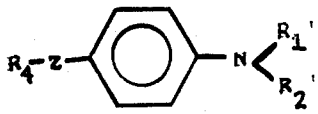

or

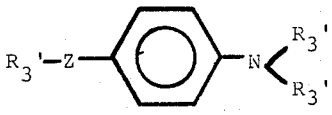

wherein the term Z represents oxo or thio; $R_1'$ represents benzyl, methyl or ethyl and $R_2'$ independently represents $R_1'$; $R_4$ represents methyl or ethyl and $R_3'$ represents benzyl or methyl substituted benzyl.

3. The photoconductor element claimed in claim 1 wherein the photoconductor compound is selected from the group of substituted aniline compounds corresponding to the formula

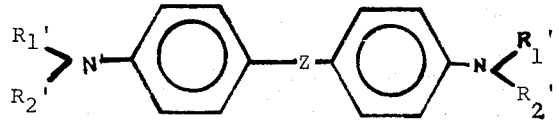

being the most preferred photoconductor compounds. In the preferred embodiments, the term Z represents oxo or thio; $R_1'$ represents benzyl, methyl or ethyl and $R_2'$ independently represents $R_1'$.

4. The new electrophotographic element of claim 1 wherein the insulating resinous binder is selected from polystyrene, polyvinyl butyral or polysulfone.

5. The electrophotographic element of claim 1 containing 9,10-phenathrenedione as a sensitizer.

6. The electrophotographic element of claim 1 wherein the photoconductor compound is N,N,N′,N′-tetrabenzyl-4,4′-oxydianiline.

7. The electrophotographic element of claim 1 wherein the photoconductor compound is N,N-dibenzyl-4-phenoxyaniline.

8. The electrophotographic element of claim 1 wherein the photoconductor compound is N,N-dibenzyl-p-anisidine.

9. The electrophotographic element of claim 1 wherein the photoconductor compound is N,N,O-tribenzyl-p-aminophenol.

10. The electrophotographic element of claim 1 wherein the photoconductor compound is N,N-dibenzyl-4-thiomethylaniline.

11. The electrophotographic element of claim 1 wherein the photoconductor compound is N,N-dibenzyl-p-phenetidine.

12. The electrophotographic element of claim 1 wherein the photoconductor compound is N,N-dibenzyl-4-thiophenylaniline.

13. An improved photoconductive layer comprising a high dielectric resinous binder and a photoconductive compound wherein the improvement comprises N,N,N′,N′-tetrabenzyl-4,4′-oxydianiline as the photoconductive compound.

14. An improved photoconductive layer as in claim 13 further including a sensitizer.

15. An improved electrophotographic element comprising a photoconductive layer coated onto a conductive support wherein the improvement comprises N,N,N′,N′-tetrabenzyl-4,4′-oxydianiline as the photoconductive compound of the photoconductive layer.

16. An improved process of electrophotographic reproduction comprising (a) charging an electrographic element comprising a photoconductive layer coated onto a conductive suppport, (b) exposing the element to a light image to produce an invisible charge pattern, and (c) developing the invisible charge pattern with an electrostatically charged toner wherein the improvement comprises N,N,N′,N′-tetrabenzyl-4,4′-oxydianiline as the photoconductive compound of the photoconductive layer.

17. An electrophotographic element comprising a conductive support having coated thereon a photoconductive composition comprising an organic photoconductor and an electrically insulating binder, said photoconductor corresponding to the formula

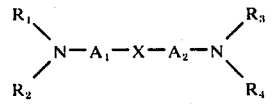

wherein $A_1$ and $A_2$ are phenylene or substituted phenylene radicals, X represents oxo, thio, dithio or sulfonyl, and $R_1$, $R_2$, $R_3$ and $R_4$ represent alkyl or benzyl radicals.

* * * * *